US005382087A

United States Patent [19]

Pouch

[11] Patent Number: 5,382,087

[45] Date of Patent: Jan. 17, 1995

[54] PORTABLE COUNTER-BAR

[76] Inventor: Thomas S. Pouch, 2747 Scarlet Oak Dr., Toledo, Ohio 43615

[21] Appl. No.: 950,200

[22] Filed: Sep. 24, 1992

[51] Int. Cl.[6] ..... A47B 43/00; A47B 47/04

[52] U.S. Cl. ..... 312/140.2; 160/135; 312/258; 312/265.5

[58] Field of Search ..... 312/140.2, 258, 265.5, 312/257.1, 265.6, 240; 220/7; 49/382; 160/135

[56] References Cited

U.S. PATENT DOCUMENTS

| | | | |
|---|---|---|---|
| D. 306,664 | 3/1990 | Pouch | D6/429 |
| 695,677 | 3/1902 | Faris | 312/265.5 X |
| 1,241,844 | 10/1917 | Gottschall | 220/7 |
| 1,336,895 | 4/1920 | Driver | 220/7 |
| 2,057,942 | 10/1936 | Fay | 220/7 X |
| 3,955,864 | 5/1976 | MacDonald et al. | 312/258 |
| 4,055,924 | 11/1977 | Beaver, Jr. | 312/265.5 X |
| 4,082,389 | 4/1978 | Stewart | 312/258 |
| 4,236,460 | 12/1980 | Poupko | 312/258 X |
| 4,579,401 | 4/1986 | Mears | 312/258 |
| 5,048,902 | 9/1991 | Daly | 312/257.1 X |

*Primary Examiner*—Joseph M. Gorski
*Attorney, Agent, or Firm*—Willian Brinks Hofer Gilson & Lione

[57] ABSTRACT

A portable bar or counter is disclosed consisting of several interchangeable parts. Interchangeable top and bottom parts fit onto a panel assembly to provide a table on which to rest objects or a podium to stand behind. The top part acts as a counter while the bottom part acts as a stabilizing base for the assembled unit. The panel assembly is made of four interchangeable panels which are hinged to each other allowing them to fold in accordion style. The connected panel assembly fits into the top and bottom parts forming a front and two sides while the rear is left open. Additional side-to-side and torsional rigidity is achieved by an interlocking shelf which attaches inside the invention. The component parts are designed to allow quick assembly and disassembly without the use of tools. When disassembled, the invention collapses to form its own carrying case with the top and bottom parts used as covers to hold the collapsed panel assembly, shelf, and other accessories.

4 Claims, 10 Drawing Sheets

PORTABLE COUNTER-BAR

FIELD OF THE INVENTION

This invention relates to a portable counter. More particularly this invention relates to counters, booths, stands, bars, podiums and the like which are collapsible and easily movable.

BACKGROUND ART

U.S. Design Pat. No. 306,664, filed Sep. 23, 1987 and issued Mar. 20, 1990 to the present inventor, Thomas S. Pouch.

SUMMARY OF THE INVENTION

The present invention is a portable and collapsible bar, podium, or the like designed for use in a variety of business and entertainment situations. It is the result of a carefully engineered design study which has led to the development of three major component parts, two of which are totally interchangeable, and all of which contribute to a completely integrated design to assure structural integrity. The apparatus is lightweight yet durable and can be easily disassembled, stored, and moved.

The top and base parts, which are interchangeable, securely receive and lock onto the front and side panel assembly to provide stability to the assembled unit. The front and side panel assembly is made of four interchangeable panels which are hinged to each other allowing them to fold flat in accordion style. Additional side-to-side and torsional rigidity is provided by an interlocking shelf. Engineered component part design allows fast and effortless assembly and disassembly without the use of tools and manufacture is of a low cost and simple nature with only a few molded parts.

When disassembled, the invention collapses to form its own carrying case with the top and base parts used as covers to hold the collapsed front and side assembly, shelf, and other accessories. The entire unit, disassembled, is easy to transport with either its molded-in handle, over-the-shoulder carrying strap or transport wheels. The invention is designed to allow alternative embodiments that will expand both its functional and ornamental applications. These are, including but not limited to, top extensions, a banner, a canopy and an umbrella.

It is an object of this invention to provide a novel counter or bar which is easily collapsible and portable.

More particularly, it is an object of the invention to provide a collapsible, portable bar or counter having parts which are functionally interchangeable and which collapses to form its own carrying case.

A further objective is to provide a counter or bar which provides a stable platform for objects and which is made of lightweight yet durable material.

Another objective is to provide a collapsible, portable bar or counter which can be quickly assembled or disassembled without tools and is thus particularly adapted for picnic, tailgate or temporary placement at a number of occasions.

Still another objective is to provide a portable counter or bar consisting of interchangeable parts with molded-in functional portions. Other objects and advantages will be apparent from the following detailed description thereof.

DETAILED DESCRIPTION OF A PREFERRED EMBODIMENT

Figure 1B:
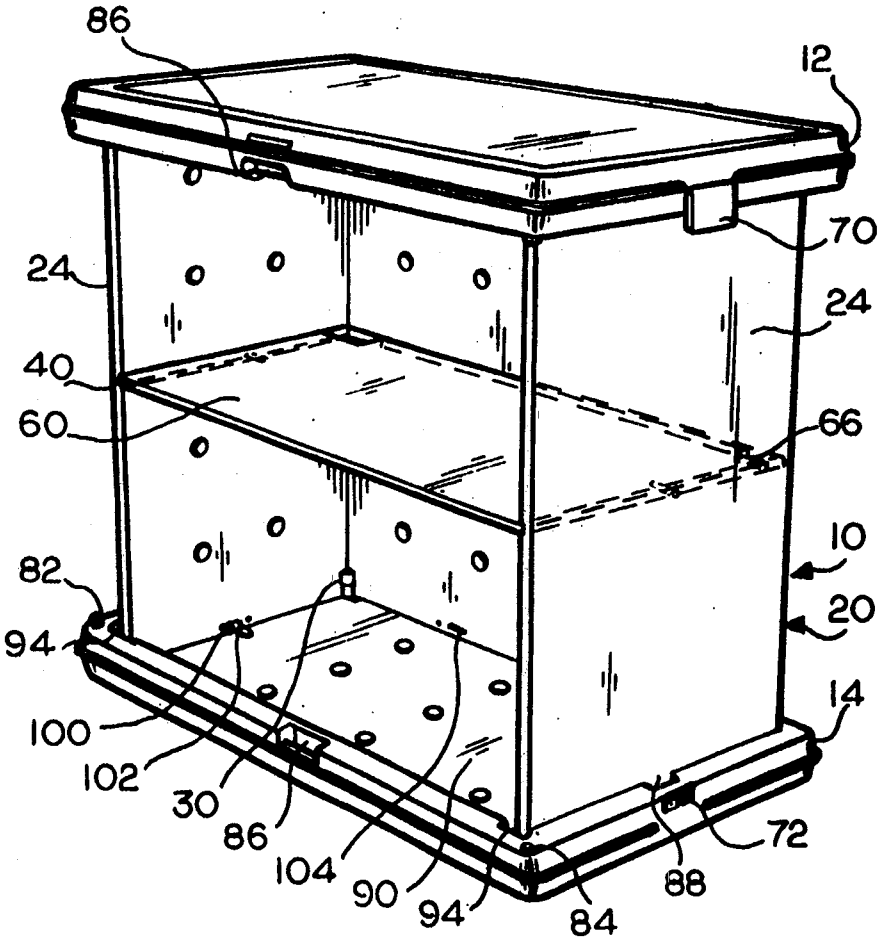
FIG. 1*b* is a back view in perspective of the present invention shown completely assembled for use as a bar or counter.
Figure 1A:
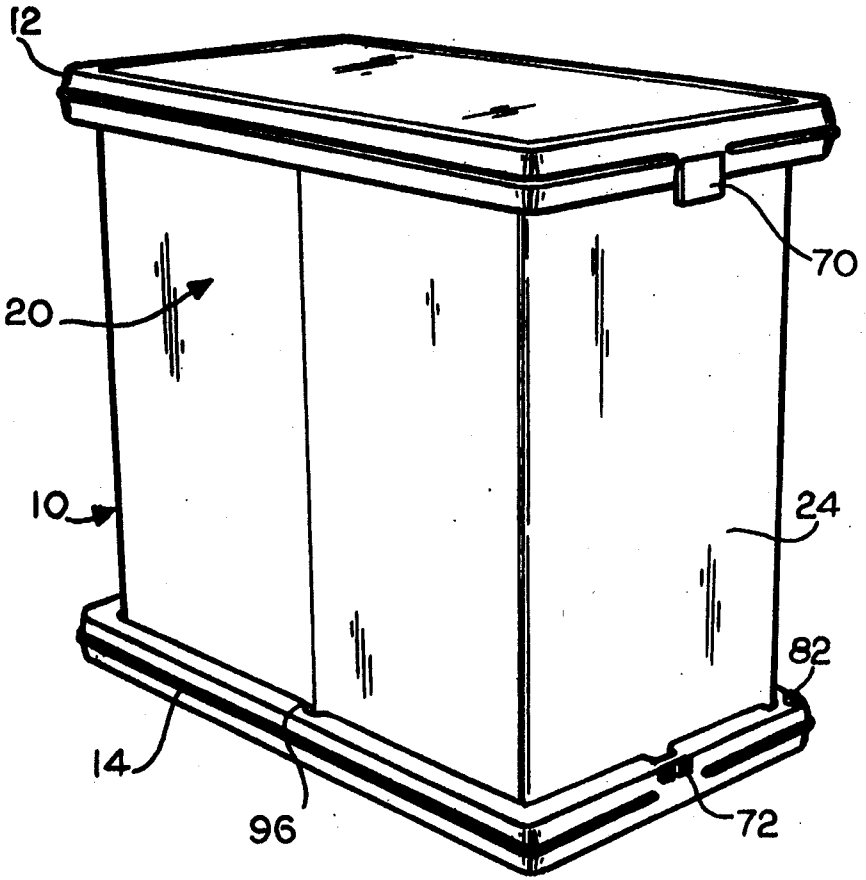
FIG. 1*a* is a front view in perspective of the present invention shown completely assembled for use as a bar or counter.
Figure 1C:
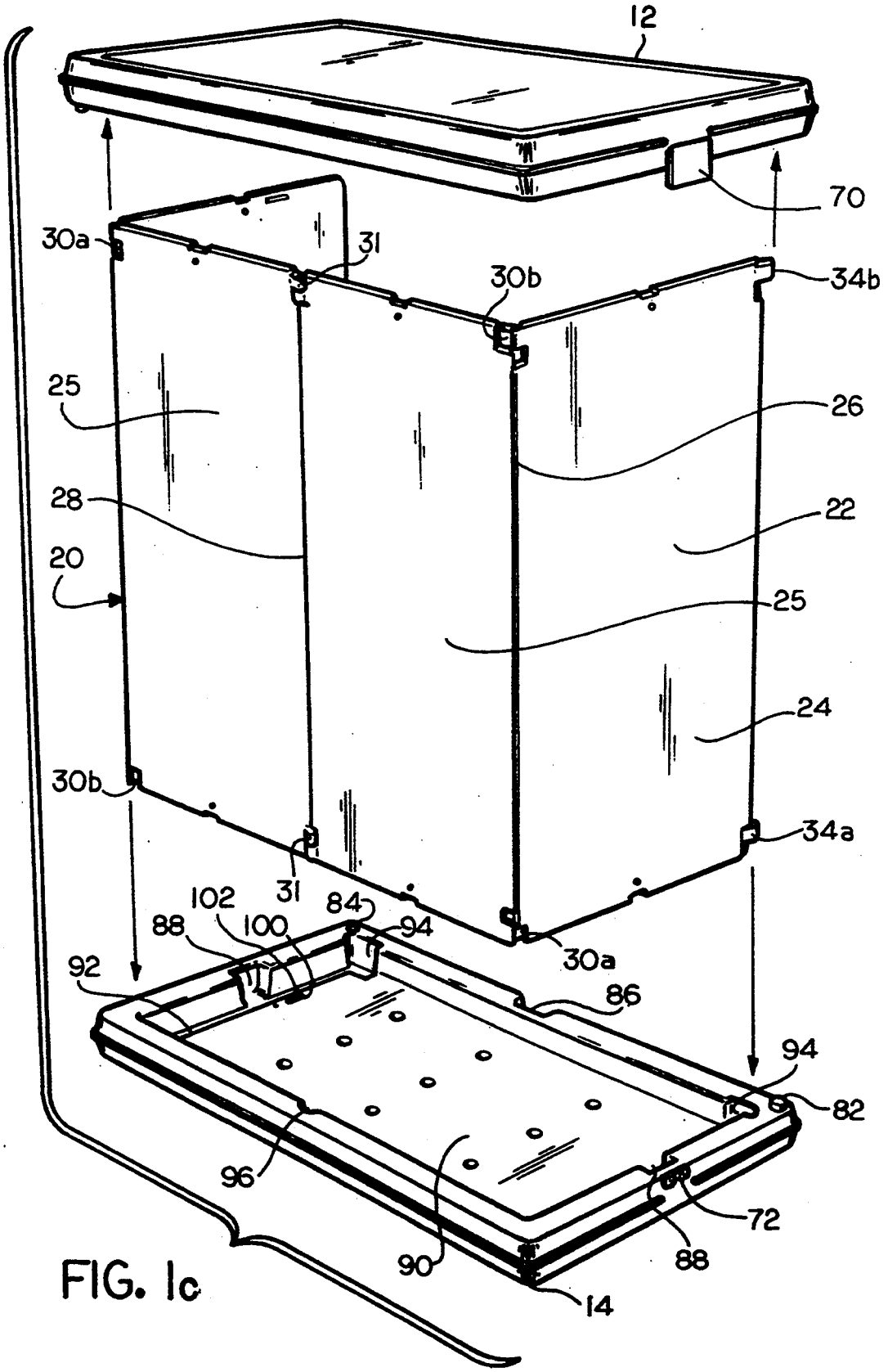
FIG. 1*c* is an exploded elevational front view in perspective of the present invention.

FIG. 1*a* shows a front view of the collapsible, portable counter-bar 10 with a top part 12, bottom part 14, and connected panel assembly 20. As is the case with conventional furniture, the invention is preferably forty inches (40") high when standing, although other heights would be acceptable. A rear view of the assembled invention is shown in FIG. 1*b*. Shelf 60 fits inside the portable counter-bar to provide additional stability and storage space, but is not necessary for structural integrity of the invention. The component parts as described, preferably made of a durable plastic, such as rotational or blow molded polyurethane or polyethylene, are shown unassembled in FIG. 1*c*.

Figure 2:
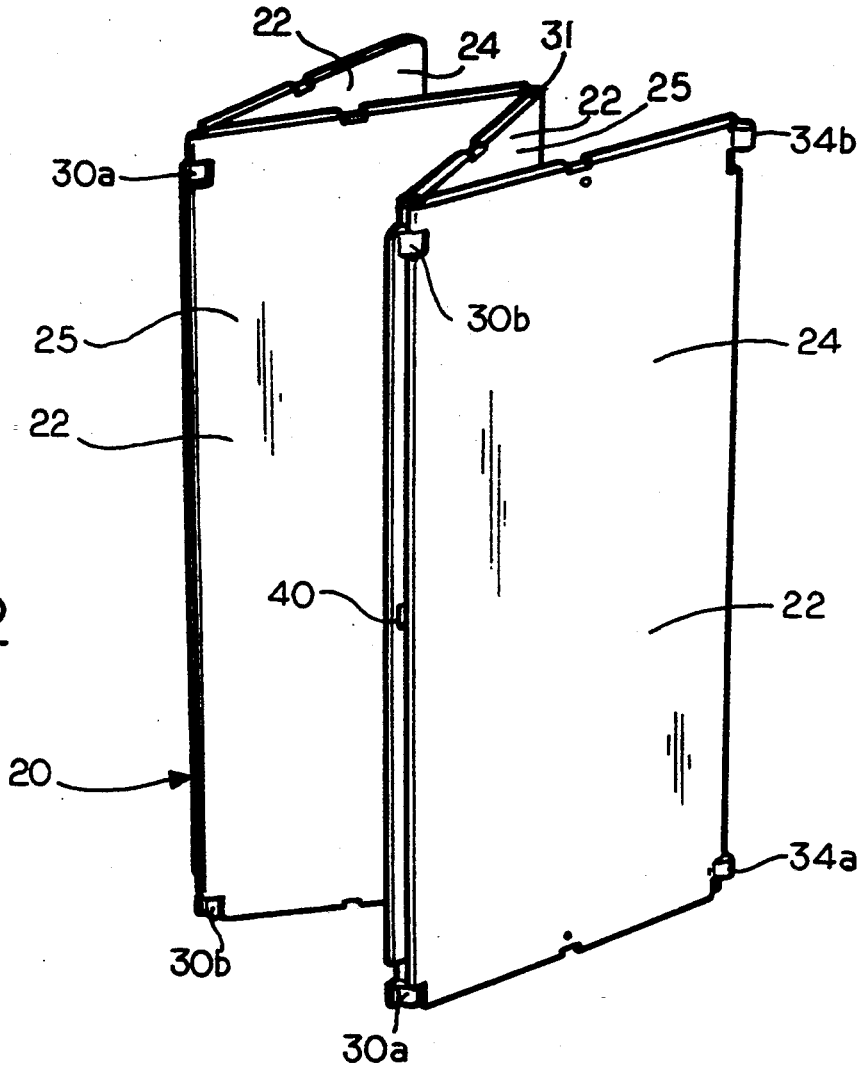
FIG. 2 shows a front and side panel assembly in partially folded condition consisting of four panels connected by hinges and pop rivets used to support a top portion and as a front and sides for the invention.
Figure 3B:
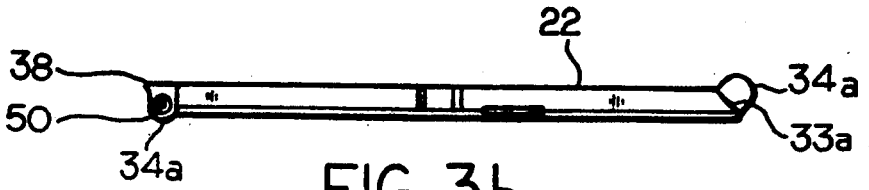
FIG. 3*b* is a top view of the panel shown in FIG. 3*a;*
Figure 3A:
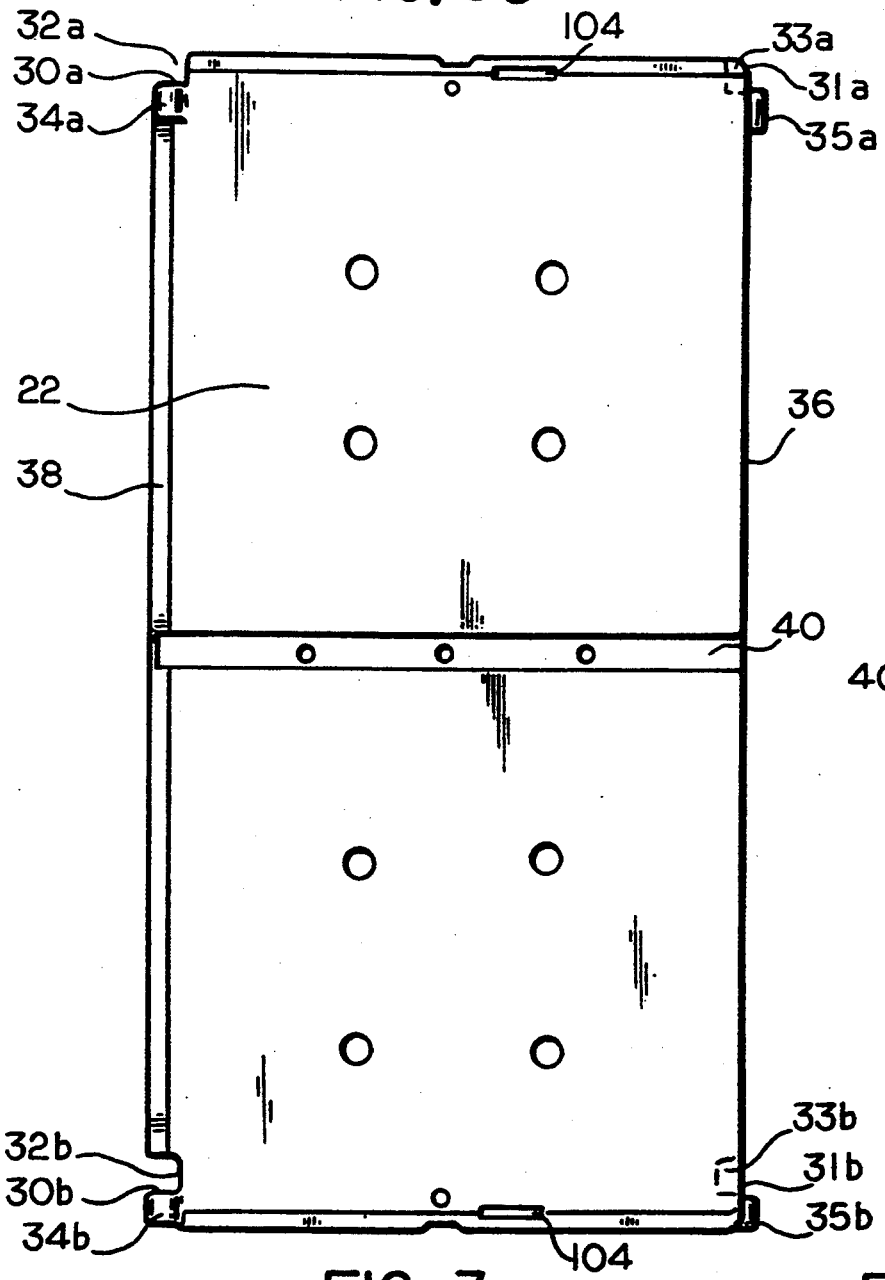
FIG. 3*a* shows a rear view in elevation of one of the interchangeable panels of the invention.

Folding panel assembly 20 consists of interchangeable panels 22 which are connected by integrally molded hinges 30 and 31, as seen in FIG. 2. A detailed inside view of an interchangeable panel 22 is shown in FIG. 3*a*. The uniquely designed molded-in hinges 30 and 31 allow panels 22 to be interchanged thus facilitating manufacture since only one panel master mold is required. A panel 22 is turned upside down to fit with an adjacent panel in the panel assembly 20. Each panel is reversed, that is, rotated 180 degrees around an axis through the face of the panel, to the panel next to it in folding panel assembly 20. Thus, any panel 22 can be used in the front portion or as a side portion of panel assembly 20.

Figure 3D:
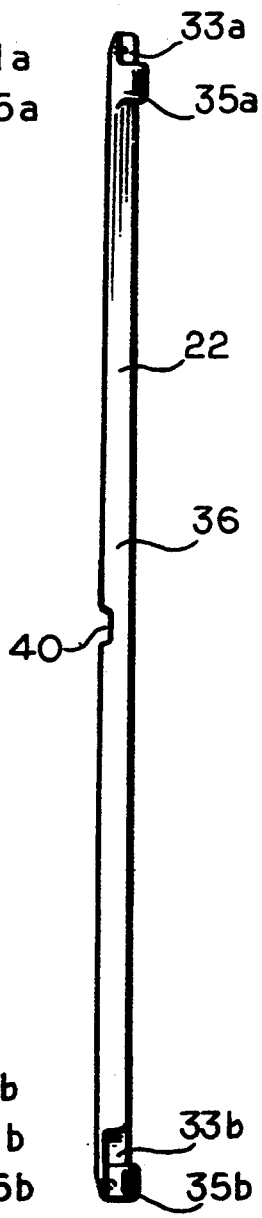
FIG. 3*d* is a side view of the panel shown in FIG. 3*a;*
Figure 3C:
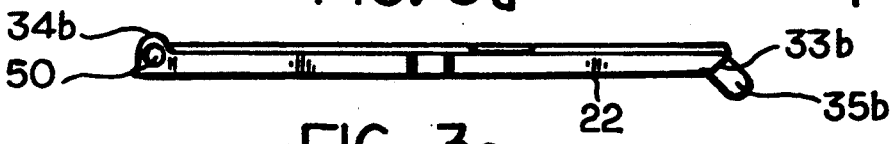
FIG. 3*c* is a bottom view of the panel shown in FIG. 3*a;*

Hinges 30 on the left side of panel 22 consist of a notch and nodule combination 32, 34 at each corner. The top left corner hinge 30*a* of panel 22 shown in FIG. 3*a* has notch 32*a* and immediately below notch 32*a* is nodule 34*a* which projects outwardly and normal to the plane of panel 22 as shown in FIG. 3*b*. The bottom left corner hinge 30*b* of panel 22 shown in FIG. 3*a* has notch 32*b* above nodule 34*b* which also projects outwardly and normal to the plane of panel 22 as shown in FIG. 3*c*. The left side 38 of panel 22 is beveled to fit an adjacent, reversed panel at right angles to each other forming a corner 26 (See FIG. 1*c*) of panel assembly 20.

Hinges 31 on the right side of panel 22 consist of a notch and nodule combination 33, 35 at each corner. The top right corner hinge 31*a* of panel 22, shown in FIG. 3*a*, has beveled notch 33*a* and immediately below notch 33*a* is nodule 35*a* which projects outwardly at an angle from the plane of panel 22 as shown in FIGS. 3*b* and 3*d*. The bottom right corner hinge 31*b* of panel 22 shown in FIG. 3*a* has beveled notch 33*b* above nodule 35*b* which also projects outwardly at an angle from the plane of panel 22 as shown in FIGS. 3*c* and 3*d*. Right side 36 of panel 22 is squared to fit with a similar side on an adjacent panel 22. Groove 40 receives a portion of shelf 60 (not shown). When four panels 22 are connected to form panel assembly 20, groove 40 on each panel 22 border one another to make a continuous ledge supporting shelf 60. Obviously, the groove 40 must be at the midpoint of the length of each panel 22.

Figure 4A:
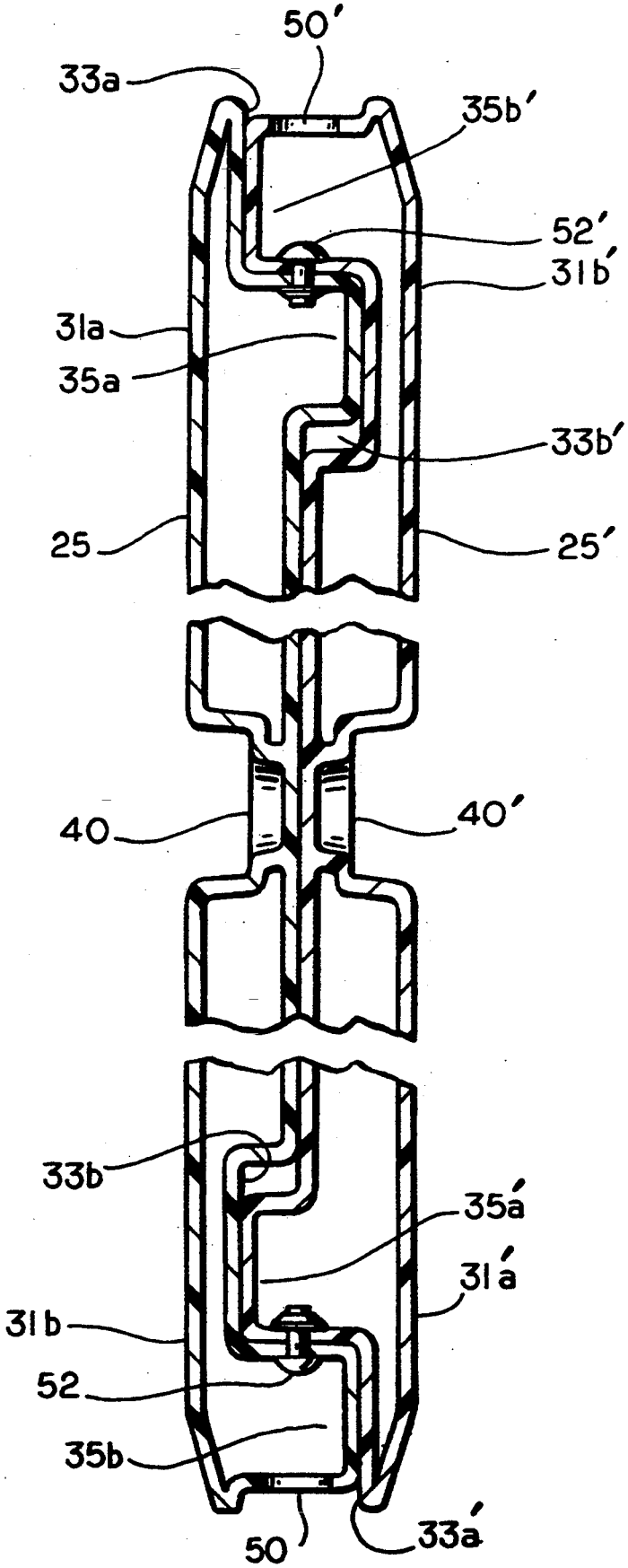
FIG. 4*a* shows in cross-section the molded-in center hinges of two panels of the invention as they fit together and are connected, depicting their reversible nature.

FIG. 4*a* shows a detailed cross-sectional view of center panels 25 and 25′ folded together with ungrooved sides facing each other and connected together by hinges 31 and 31′. These two hinges form the connection 28 of panel assembly 20 along sides 36 and 36′ of center panels 25 and 25′, respectively. The reversible nature of the interchangeable panels 22 is clearly shown in this figure. Numbers followed by an apostrophe indicate parts of panel 25′. Other (unprimed) numbers indicate parts of panel 25. Nodule 35*b*′ fits next to notch 33*a* and over nodule 35*a*. Nodule 35*a* fits next to notch 33*b*′ and is connected to nodule 35*b*′ by fastener 52′, such as a rivet or the like, which is attached through hole 50′. Similarly, nodule 35*a*′ fits next to notch 33*b* and over nodule 35*b*. Nodule 35*b* fits next to notch 33*a*′ and is connected to nodule 35*a*′ by fastener 52, such as a rivet or the like, which is attached through hole 50. Molded-in shelf groove 40 is shown in a side view.

Figure 4B:
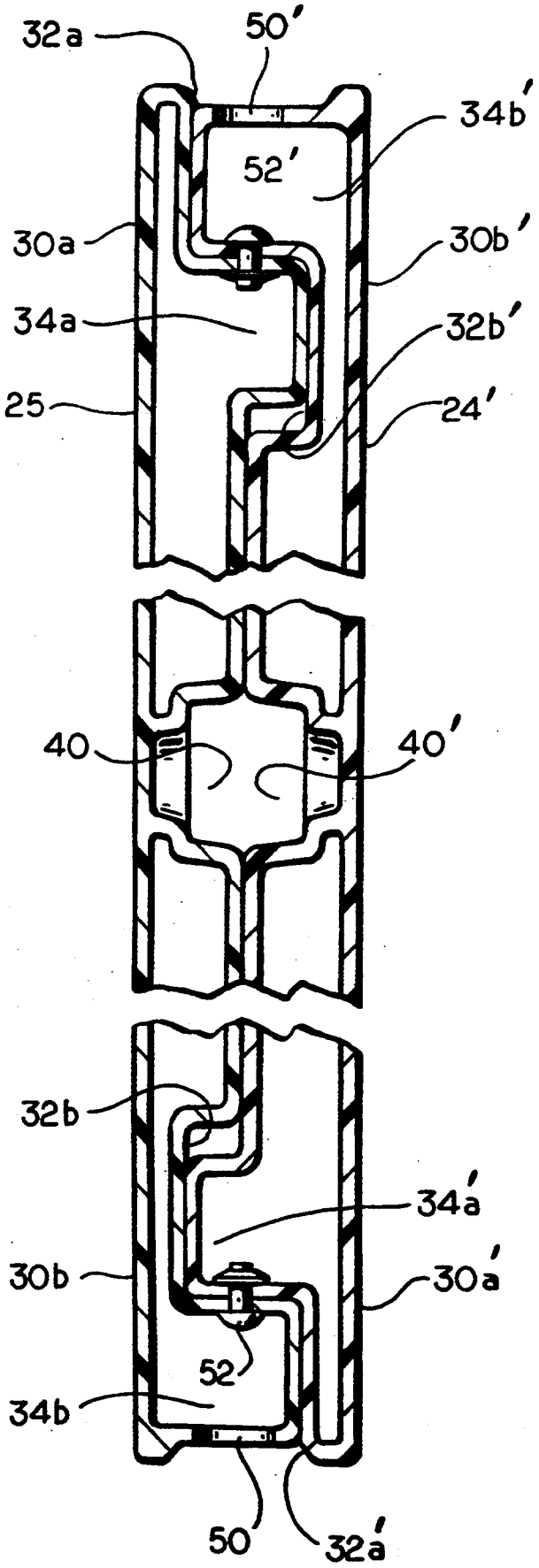
FIG. 4*b* shows in cross-section the molded-in corner hinges of two panels of the invention as they fit together and are connected, depicting their reversible nature.

FIG. 4*b* shows a detailed view of two panels, center panel 25 and side panel 24′, folded together with grooved sides facing each other and connected together by corner hinges 30 and 30′. Numbers followed by an apostrophe indicate parts of a side panel 24′. Other (unprimed) numbers indicate parts of a center panel 25. Nodule 34*b*′ fits next to notch 32*a* and on top of nodule 34*a*. Nodule 34*a* fits next to notch 32*b*′ and is connected to nodule 34*b*′ by fastener 52′, such as a rivet or the like, which is attached through hole 50′. Similarly, nodule 34*a*′ fits next to notch 32*b* and on top of nodule 34*b*. Nodule 34*b* fits next to notch 32*a*′ and is connected to nodule 34*a*′ by fastener 52, such as a rivet or the like, which is attached through hole 50. Molded-in shelf groove 40 is shown in a side view.

Figure 6:
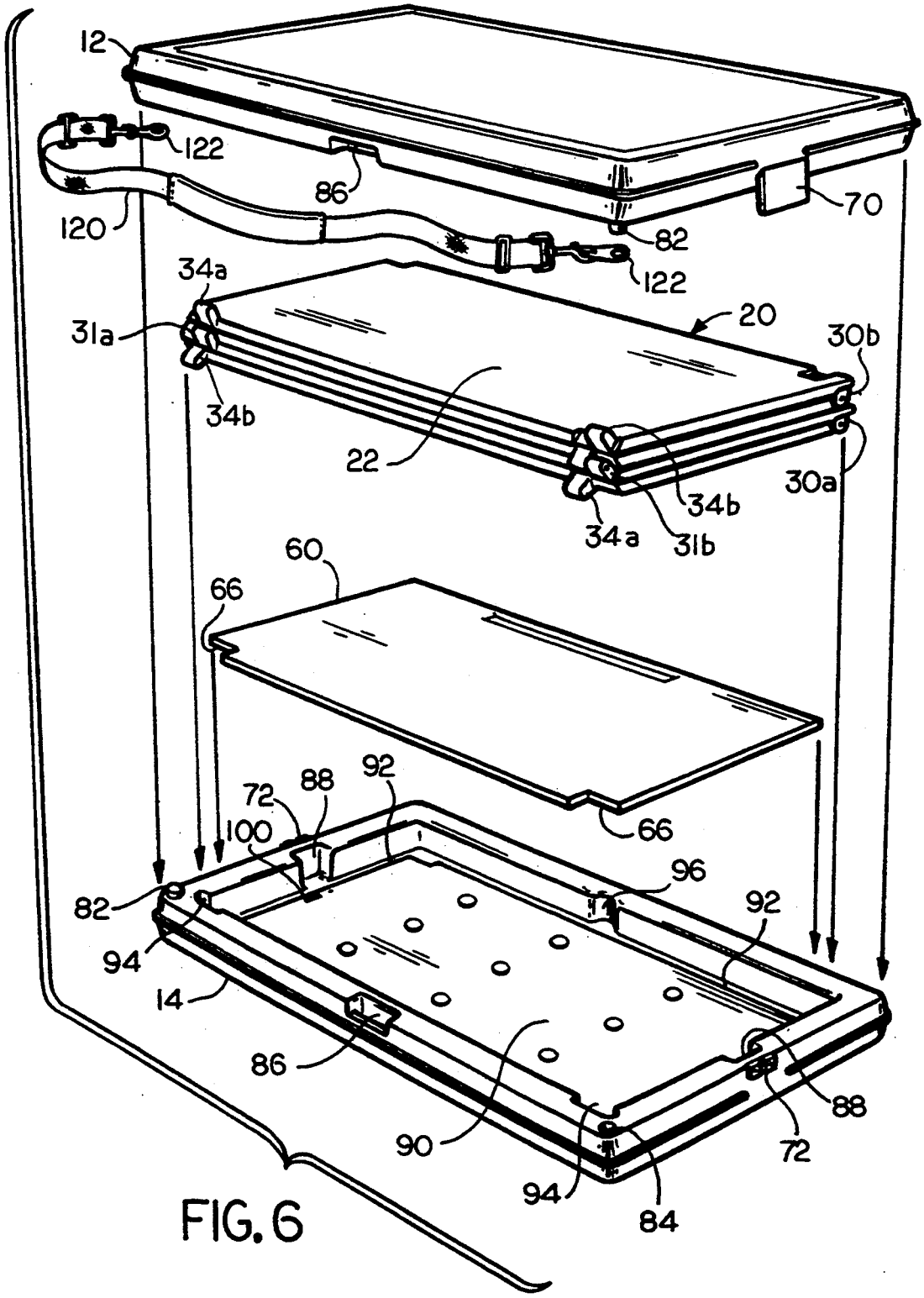
FIG. 6 is an exploded perspective view in elevation of the invention as it would fit together to form its own carrying case.

As seen in FIG. 1*b*, shelf 60 slides into and rests on molded-in grooves 40. Two corners of shelf 60 have square shelf notches 66 which allow it to lie flat next to folded panel assembly 20 when packed for storage. The shelf notches 66 receive protruding nodules from a panel 22 of folded panel assembly 20 as shown in FIG. 6.

The top 12 fits over panel assembly 20 and is interchangeable with bottom 14. (See FIGS. 1*a*–1*c*). Draw latches 70, preferably a commercially available plastic type, are located on the ends to provide case closure and locking.

Figure 5:
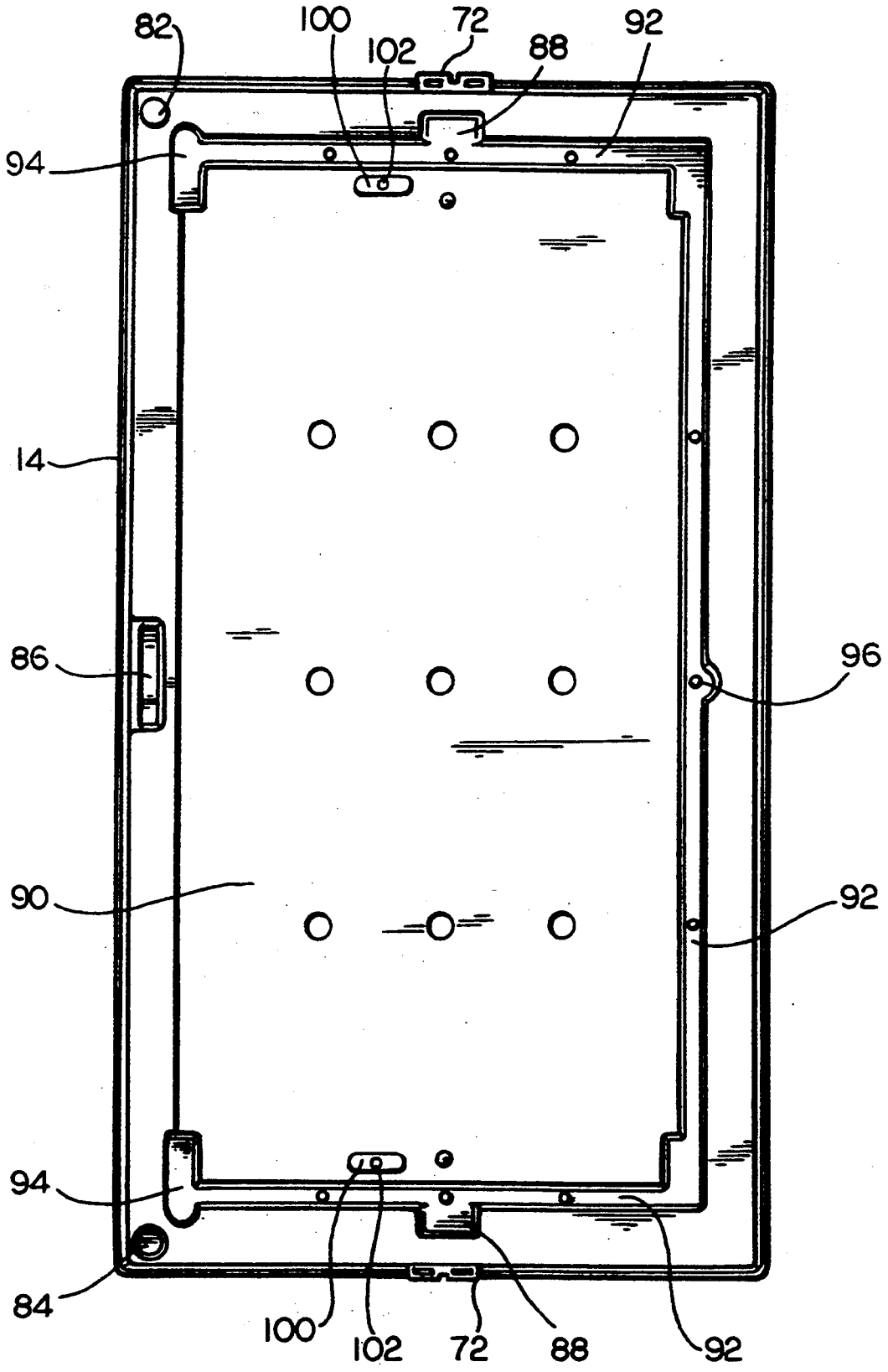
FIG. 5 is a top view of the common top/bottom part of the invention showing the molded-in features.

Bottom 14, which is interchangeable with top 12, has receivable draw latch connector 72. FIG. 5. Draw latch 70 fits over and connects to draw latch connector 72 keeping top 12 and bottom 14 together. Both top 12 and bottom 14 have molded-in recessed carrying handle 86. Panel assembly 20 is set into recess 92 which runs along three sides of the inside perimeter of bottom 14. A similar groove in top 12 also retains panel assembly 20. Molded-in receptacles 94 receive nodules 34 of hinge 30 of side panels 24. Receptacle 96 receives nodules 34 of hinges 31 of the two front panels 25 when panel assembly 20 is effected in recess 92. Space 90 provides storage for panel assembly 20 when folded, shelf 60, and other accessories.

Panel assembly 20 is secured to bottom part 14 and top part 12 with latch 100, preferably metal, which attaches to bottom 14 and top 12 via pop rivet 102. Latch 100 is rotatable around pop rivet 102 and in the locked position fits into slit 104 in both side panels 24. See FIGS. 1*b* and 5.

Figure 7:
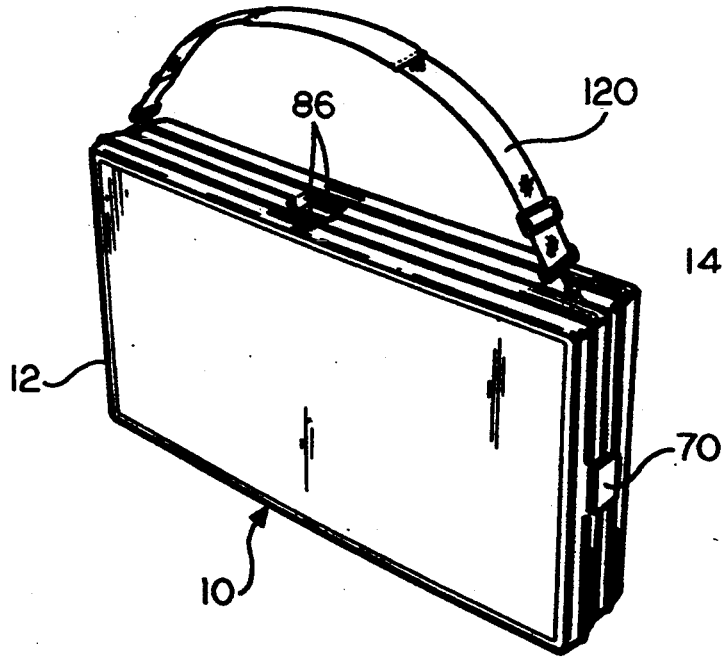
FIG. 7 is a view of the invention showing the carrying strap as it connects to the top and base parts with a strap swivel.
Figure 8:
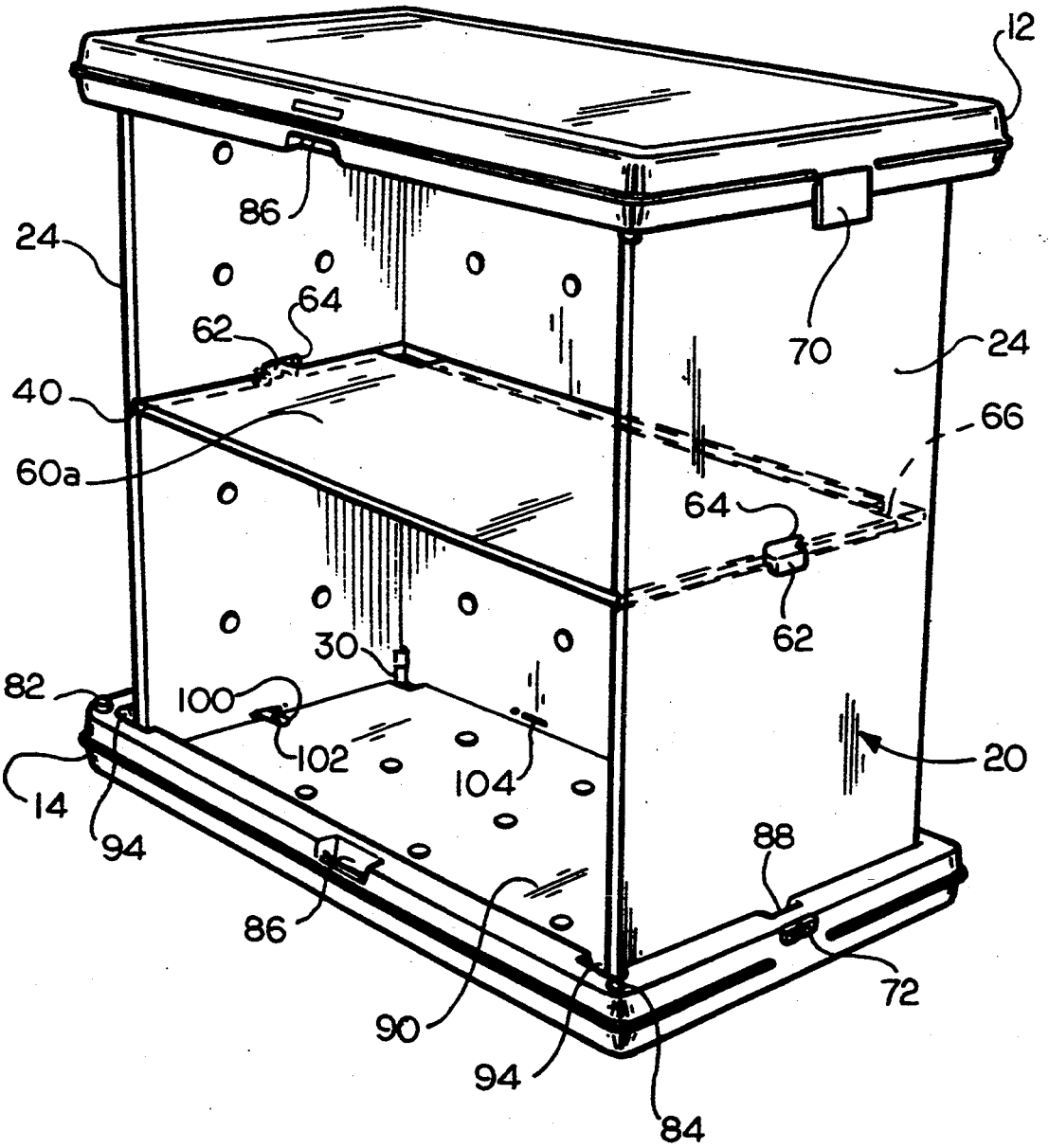
FIG. 8 is an alternative embodiment of the invention with a shelf that has interlocking protuberances on each end that fit into the sides of the panel assembly.

Storage of panel assembly 20 and shelf 60 is depicted in FIG. 6. Top 12 and bottom 14 fit together to form a carrying case 10 for the other parts as seen in FIG. 7. Each part forms one half of the carrying case. Molded-in locator pin 82 and locator pin receptacle 84 align top 12 and bottom 14 and provide attachment of carrying strap hardware. As seen in FIG. 8, a locator pin 82 on bottom 14 fits into a locator pin receptacle 84 on top 12. Carrying strap 120, shown in FIGS. 6 and 7, can be attached to locator pins 82 with strap swivel 122. As top 12 and bottom 14 attach by draw latches 70 and 72, locator pins 82 fit into receptacles 84 through a center portion of strap swivel 122 forming a support for carrying strap 120.

An alternative embodiment of the shelf of the present invention is shown in FIG. 8. This alternate shelf 60*a* has shelf connection means 62 on each end which are positioned to fit through holes 64 in side panels 24. Holes 64 are preferably located near the center of side panels 24 and open into groove 40. Two versions of alternative shelf connection are depicted in FIGS. 9*a* through 9*d*, although many other shelf connection means are possible, such as a knob with a threaded shank (not shown) which fits through holes 64 and screws into a threaded rivet in shelf 60*a*. In the exposed version of the alternative embodiment shown in FIG. 9*a*, the connection means 62 are protuberances. Protuberances 62 fit through holes 64, over groove 40, clip onto side panel 24 via lips 68, and extend beyond the plane of side panels 24. In the recessed version of FIG. 9*c*, hole 64 is molded such that an outside ledge 74 receives lip 68 of protuberance 62. Protuberance 62 fits through hole 64, over groove 40 and clips onto ledge 74 such that it remains flush with the plane of side panel 24.

Figure 9A:
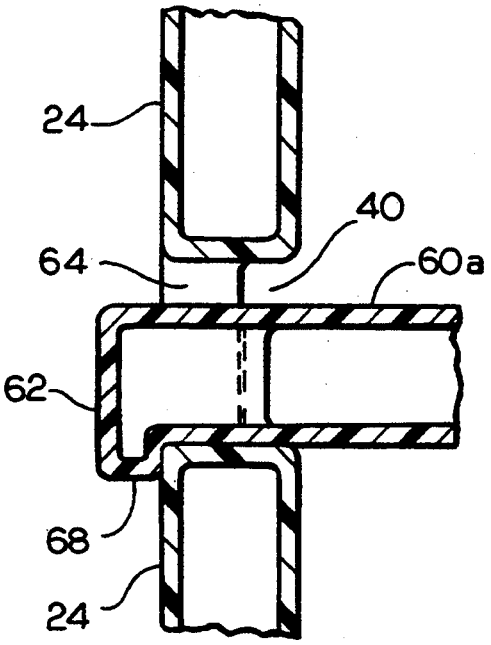
FIG. 9*a* shows a side view of an exposed shelf fastener as it attaches to a panel of the invention.
Figure 9C:
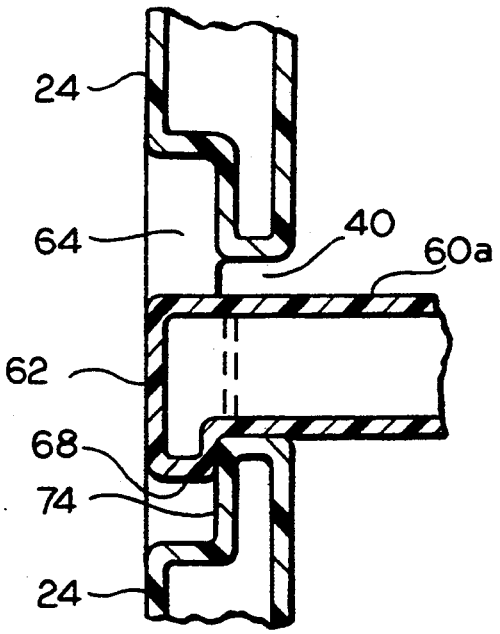
FIG. 9*c* shows a side view of a recessed shelf fastener as it attaches to a panel of the invention.
Figure 9B:
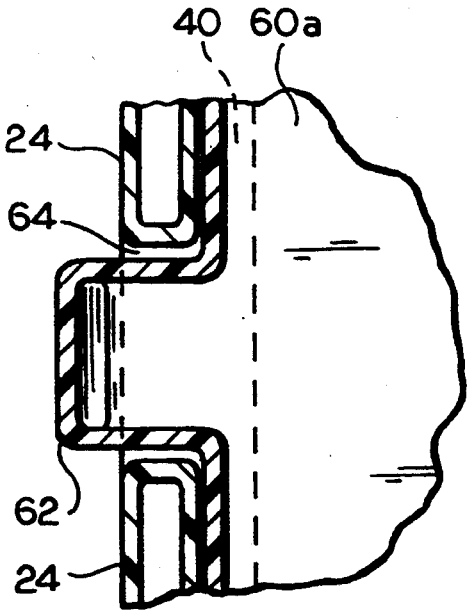
FIG. 9*b* shows a top view of an exposed shelf fastener as it attaches to a panel of the invention.
Figure 9D:
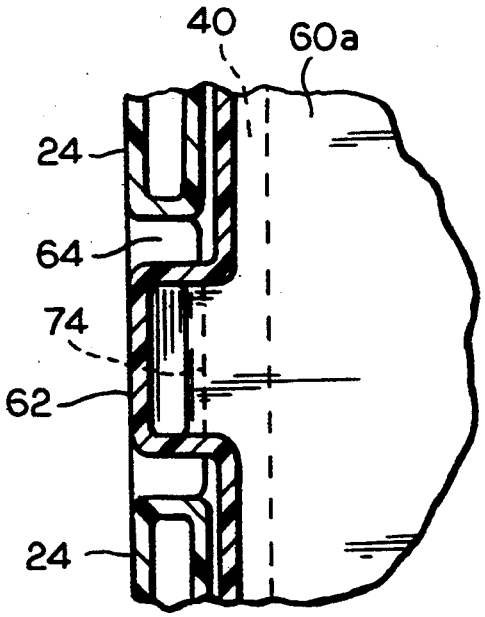
FIG. 9*d* shows a top view of a recessed shelf fastener as it attaches to a panel of the invention.

Top views of the exposed and recessed versions of the shelf connection mechanism are shown in FIGS. 9*b* and 9*d*, respectively. Notches 88 on either end of top 12 or bottom 14 receive protuberances 62 of shelf 60*a* when stored in space 90.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

I claim:

1. A foldable stand comprising: four panels, a top member, and a bottom member, each panel having a first edge, a second edge, a top edge, a bottom edge, and front and back planar surfaces with said first edge being beveled at an angle relative to said planar surfaces, and said second edge being perpendicular to said planar surfaces, a notch formed in each of said first and second edges at the top and bottom thereof, and a nodule formed on each of said first and second edges at the top and bottom thereof beneath each notch, each bottom notch being defined by a top surface section, a bottom surface section, and an inner surface section, each top notch being defined by a bottom surface section and an inner surface section and being open at its top, each of said inner surface sections of said notches on said first edge being beveled at an angle relative to said planar surfaces and each of said inner surface sections of said notches in said second edge being perpendicular to said planar surfaces, each nodule extending normal to said inner surface section located thereabove, said nodules on said first edge of each panel being received within said notches in said first edge of an adjacent panel, and aid nodules on said second edge of two of said panels being received within said notches in said second edge of said two panels, thereby forming a panel assembly said top and bottom edges of said panels being received in said top and bottom members, respectively, said top member and said bottom member being interchangeable in that each may be used as the other, and said top member being capable of connection with said bottom member, said panel assembly capable of being folded and stored in said connected top and bottom members.

2. The stand of claim 1 and further comprising a shelf capable of fitting between said sides of said panel assembly said panels each having a groove to receive a portion of said shelf, said panel assembly connected together such that said grooved sides are adjacent to each other forming a continuous groove along the inside of said panel assembly, said shelf also being storable within said space between said top and said bottom when connected to form a case.

3. The stand of claim 2 wherein said shelf further comprises two ends, each of said ends having a protuberance with a lip, said protuberances fitting into holes through said grooves in said side panels, respectively, said protuberances extending completely through said holes and extending beyond a plane formed by an outside face of each of said side panels, said lip fitting over said outside faces.

4. The stand of claim 2 wherein said shelf further comprises two ends, each of said ends having a protuberance with a lip, said protuberances fitting into holes through said grooves in said side panels, respectively, said protuberances extending into said holes but not extending beyond a plane formed by an outside face of each of said side panels, said holes having a ledge not extending completely through said side panels such that said lip fits over said ledge.

* * * * *